United States Patent [19]

Altman

[11] Patent Number: 4,974,310

[45] Date of Patent: Dec. 4, 1990

[54] METHOD OF MANUFACTURING A SELF-CLEANING BATHTUB

[76] Inventor: Murray Altman, 20421 Chapter Dr., Woodland Hills, Calif. 91364

[21] Appl. No.: 335,724

[22] Filed: Apr. 10, 1989

Related U.S. Application Data

[62] Division of Ser. No. 108,835, Oct. 15, 1987, Pat. No. 4,868,934.

[51] Int. Cl.[5] ..... B23P 11/00

[52] U.S. Cl. ..... 29/525.1; 29/469

[58] Field of Search ..... 4/490, 492, 662, 615, 4/541, 542, 628, 584, 233, 661, 538, 546, 559; 128/66; 134/100, 167 R, 168 R; 29/434, 469, 817, 525.1

[56] References Cited

U.S. PATENT DOCUMENTS

| | | | |
|---|---|---|---|
| 3,521,304 | 7/1970 | Chiz | 4/490 |
| 4,114,206 | 9/1978 | Franc | 4/490 |
| 4,383,341 | 5/1983 | Altman | 4/490 X |
| 4,853,987 | 8/1989 | Jaworski | 4/452 |

*Primary Examiner*—Timothy V. Eley
*Assistant Examiner*—Frances Chin
*Attorney, Agent, or Firm*—Lewis Anten

[57] ABSTRACT

An improved self-cleaning bathtub having a reservoir large enough for multiple usages and an improved unitary water diversion system is disclosed.

3 Claims, 5 Drawing Sheets

METHOD OF MANUFACTURING A SELF-CLEANING BATHTUB

This is a division of application Ser. No. 07/108,835, filed on Oct. 15, 1987 U.S. Pat. No. 4,868,934.

BACKGROUND OF THE INVENTION

It has been a long sought goal, particularly for industrial establishments, such as hotels, to have a bathtub which is automatically cleaned after use. Such prior attempts have not been sufficiently practical and efficient to be implemented in general usage.

For example, in a patent to the present inventor, U.S. Pat. No. 4,383,341 issued May 17, 1983, a spring loaded series of spray nozzles were used to spray the sides of the bathtub. However, the device, with the numerous elements, was difficult to manufacture and was also inconvenient to use, since it required that cleaning detergent be added prior to each use.

Such disadvantages made it difficult to economically and reliably manufacture the self-cleaning bathtub, and also made the use of the bathtub less than desirable.

OBJECTS OF THE INVENTION

It is an object of the present invention to provide an apparatus for a self-cleaning bathtub that is more efficient than previously available bathtubs.

It is another object of the present invention to provide a self-cleaning bathtub which can truly be operated automatically.

It is another object of the present invention to provide a more reliable self-cleaning bathtub than previously available.

It is another object of the present invention to provide a self-cleaning bathtub which can be manufactured easier and more reliably than previously available self-cleaning bathtubs.

These and other objects of the present invention will be evident from the review of a accompanying disclosure in the specification and the drawings.

SUMMARY OF THE INVENTION

In the present invention the bathtub is surrounded by a conduit, comprising a tubular member having one flattened side, and closed at one end. The other end is connected to a source of water and detergent. Nozzles in openings formed in the conduit and the wall of the bathtub direct the flow of water and cleaning mixture in a downward direction to spray against the side walls of the bathtub. A nozzle cover is provided to fit over the nozzles, providing a pleasing appearance and also providing a uniform surface which is more comfortable to the body than the nozzle.

The hollow tubular conduit is attached, by fiberglass, adhesive or other means, directly to the outside wall of the bathtub structure. A series of hollow expansion nuts are passed directly through openings in the wall of the bathtub structure and openings through the flat surface of the hollow tubular conduit member. The expansion nuts, when expanded, bolt the hollow tubular conduit member to the wall of the bathtub. The expansion nut has a threaded opening which creates a complete watertight passage from the tubular conduit member into the inside of the bathtub.

The use of the expansion nuts directly into the hollow tubular conduit member eliminates alignment problems and prevents leakage of the water and cleaning fluid into the fiberglass holding the conduit in place.

A suitable water and cleansing fluid control, is provided for automatically-cycling water and cleaning solution through the hollow tubular conduit and out of the nozzles against the sides of the bathtub. The control senses the emptying of the tub to automatically activate the cleansing cycle after each use. The detergent is mixed with the water supply by means of a venturi aspirator device. A container stores enough cleaning fluid for a number of cleanings.

DETAILED DESCRIPTION OF THE DRAWINGS

Figure 1:
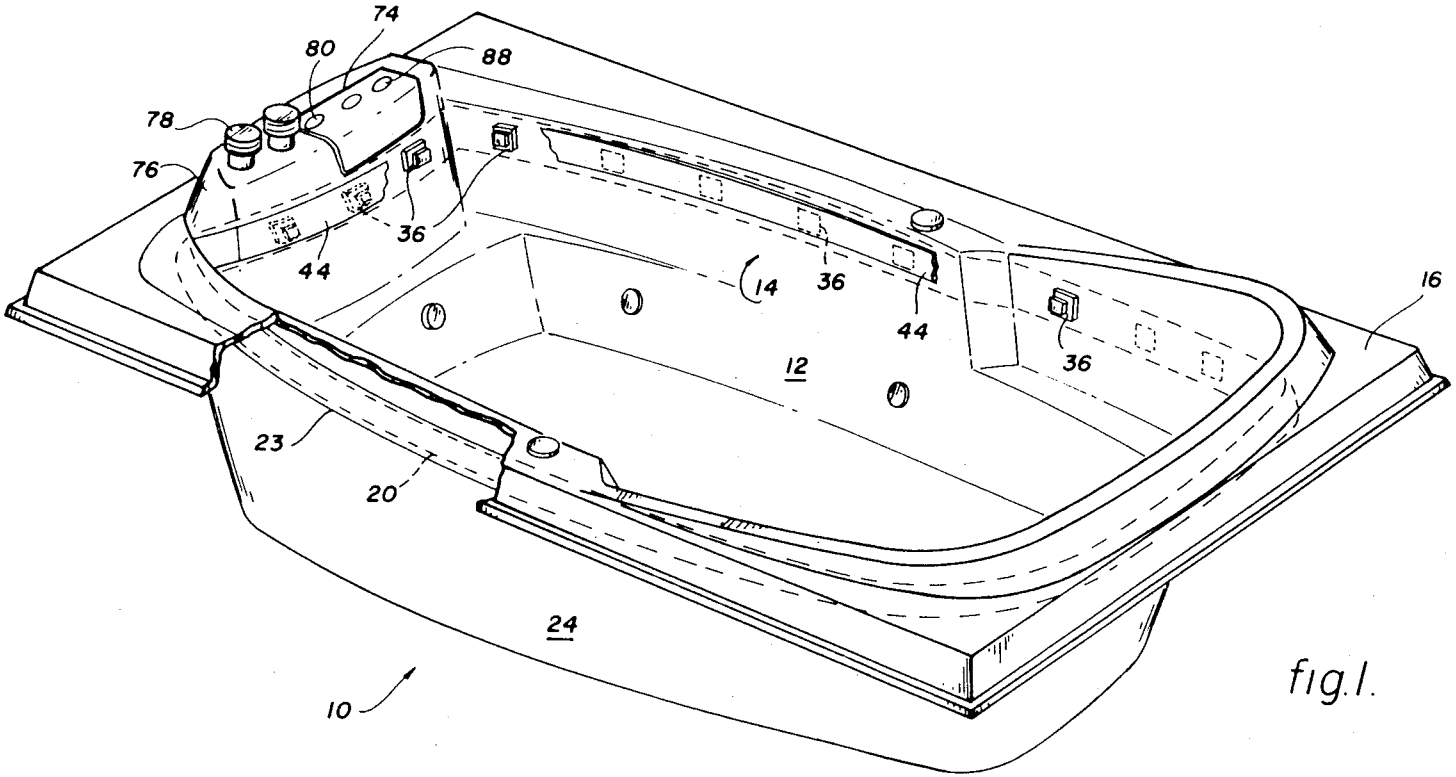
FIG. 1 is a right-hand perspective view of the improved self-cleaning bathtub.

Referring to FIG. 1 the bathtub structure 10 of the present invention is shown. The bathtub 10 consists of a substantially concave, one-piece structure 12, with steeply sloping side walls 14. A ledge 16 is formed integrally with the bathtub, about its periphery 18 so as to permit the bathtub 10 to rest in an enclosure, not shown, or to be used in conjunction with a front apron, also not shown. The bathtub 10 typically rests on a leveling board when installed.

Figure 5:
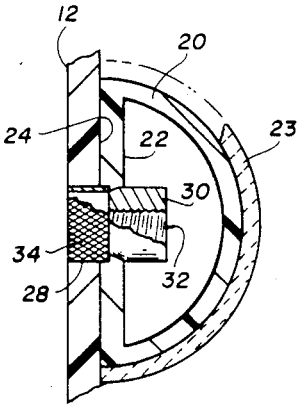
FIG. 5 is a sectional view of the expansion nut prior to expansion.
Figure 6:
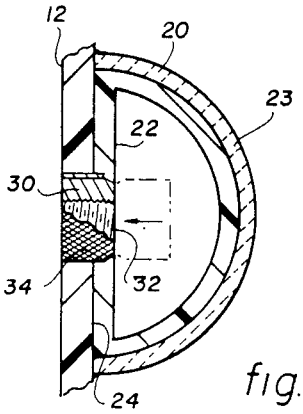
FIG. 6 is a sectional view of the expansion nut after expansion.
Figure 7:
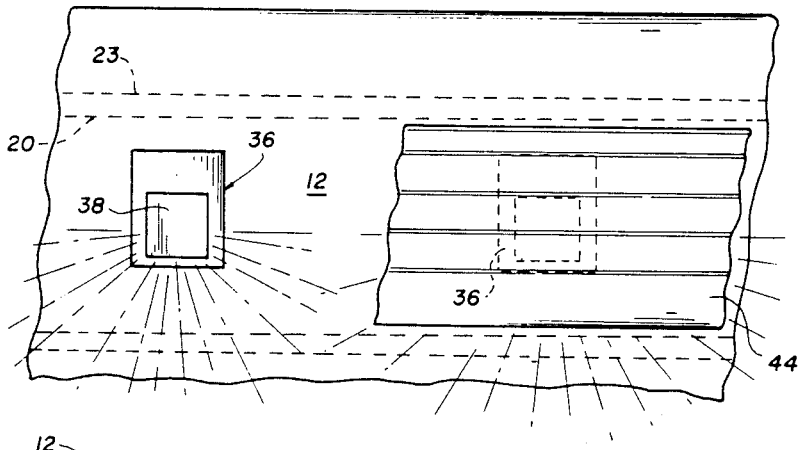
FIG. 7 is a diagrammatic view of the fluid spray flow.

A hollow tubular conduit 20 consisting of a semi-circular hollow tube with a substantially flat side 22, shown in FIGS. 5 and 6, encircles the outer upper portion 18 of the bathtub 10. The flat portion 22 of the hollow tubular conduit 20 is maintained against the outer wall 24 of the bathtub.

Figure 4:
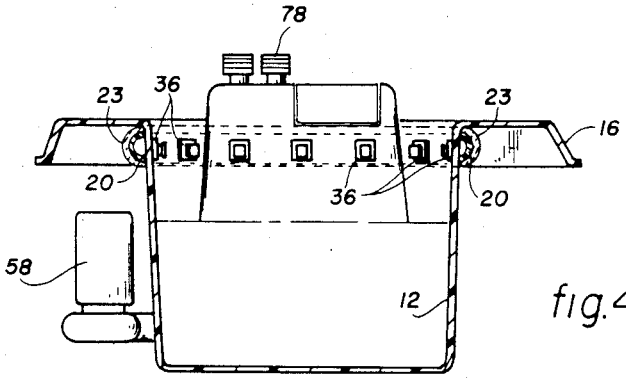
FIG. 4 is a left sectional view taken along lines 4—4 of FIG. 1.

The hollow tubular conduit is initially held in place against the outer wall 24 of the bathtub 10 by fast setting fiber glass spray 23, shown in FIG. 4.

The hollow tubular conduit 20 is made of standard PVC, which in the preferred embodiment is approximately $2\frac{3}{8}$ inches in diameter and has a wall thickness of approximately $\frac{1}{8}$ inches. Such a material is somewhat flexible so that it can be formed or bent so as to substantially conform to the shape of the outer wall 24 of the bathtub 10.

There are a series of openings 28 through the side wall 14 of the bathtub and passing through the flat side 22 of the hollow tubular conduit 20. A threaded expansion nut 30 is fitted within each of the openings 28. The expansion nut 30, shown in detail in FIGS. 5 and 6, consists of an internally threaded portion 32 and a knurled portion 34, which when the expansion nut 30 is expanded in the manner explained below, serves to lock the hollow tubular conduit 20 to the wall 12 of the bathtub 10, in a leak-proof arrangement.

In each of the threaded openings 32 in the expansion nuts 30 is fitted a complementary threaded nozzle 36. The nozzle 36 is shown in greater detail in FIG. 8. In the preferred embodiment approximately twenty three nozzles are uniformly spaced around the inside wall 12 of the bathtub 10. The openings of the nozzles 36 have an approximate inside diameter of ⅛ inch.

The portion of the nozzle 36 extending into the bathtub 10 has a deflector member 38 which serves to direct the flow of fluid in a generally downward direction through slot 40.

The slot 40 of the nozzle 30 directs the flow of fluid at an approximate angle of 15 degrees to the side of the bathtub, so as to have the fluid contact the side wall 12 of the bathtub 10 near to the slot 40.

The nozzle 36 has cover attaching means 42*a* and 42*b* for receiving a nozzle cover 44. The cover attaching means 42*a* comprises a narrowed portion 46 of the nozzle defining a head 48. Cover attaching means 42*b* consists of a lip 50 formed between the nozzle 36 and the wall 12 of the bathtub.

Nozzle cover 44 is preferably made of a flexible material which has an inner portion 52 consisting of a series of resilient projecting ribs 54*a*, 54*b* and 54*c*. Projecting ribs 54*a* and 54*b* are of such a size to fit over head 48 and grasp the narrow portion 46. Upper rib 54*c* fits over lip 50 holding the cover in place.

Figure 2:
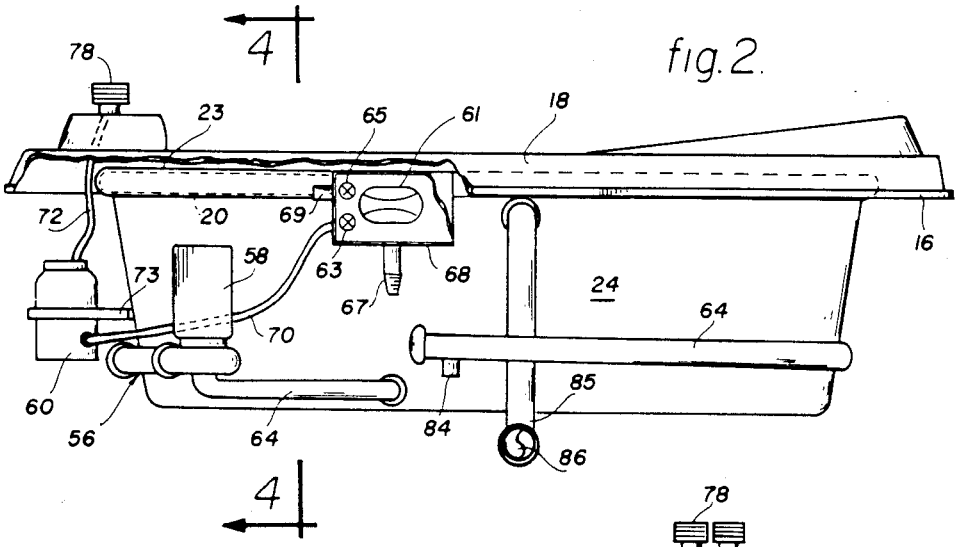
FIG. 2 is a right side view of the improved self-cleaning bathtub.
Figure 3:
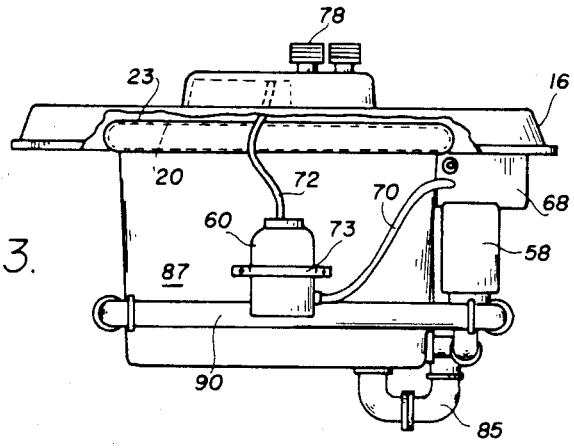
FIG. 3 is a partial sectional end view of the self-cleaning bathtub.

The tubular conduit 20 is connected to the cleaning fluid control system 68 as shown in FIGS. 2 and 3. The cleaning fluid control system 68 comprises a venturi aspirator device 61, and two solenoid controls 63 and 65 connected to electronics package 59 by suitable electrical wires. An input 67 to the venturi device 61 is connected to a source of water under pressure, not shown. The output 69 of the venturi device is connected to the hollow tubular conduit 20. The detergent container 60, attached by bracket 73 to the wall 87 of the bathtub, has an output tube 70 connected to the low pressure input of venturi aspirator device 61. Solenoid activated control 63 opens and closes access to the output tube 70 of the container 60. Solenoid activated control 65 opens and closes access to the output of the venturi aspirator device.

A tube 72 is provided for permitting the container 60 to be filled. The filling tube 72 extends to a position where it can be accessed from above the control panel 74.

Control panel 74 is accessible at the head 76 of the bathtub 10, proximate the hot and cold water handles 78. The control panel 74 has a "low detergent" indicator light 80, a manual "on" switch 82 for activating the system, and a whirlpool control 88.

Water sensor 86, located in a drainage pipe 85, first senses the presence of water draining from the bathtub, enabling the control system 68. When self-cleaning sensor 86 thereafter senses the absence of the flow of fluid in the drain, the cleaning cycle is then started.

The water sensor 86 can be a pressure switch which is activated by the pressure of water flowing through the drain, a flow meter sensing no flow through the drain or a switch which is activated by the conductivity of water.

The operation of the self-cleaning bathtub is as follows: after the bathtub is used, water sensor 86 in the drain 85 senses that water is leaving the bathtub 10, enabling the system. After the water is drained from the bathtub 10, the water sensor 86 senses that there is no longer fluid flowing through the drain 85 and activates solenoid 65 to open the line permitting water to flow from inlet 67 through the venturi aspirator device 62 and into the hollow conduit 20. The water passes, under pressure, through nozzles 36, spraying against the side walls 12 of the bathtub 10. After a preset amount of time of about 30 seconds, the solenoid switch 63 opens access to the output tube 70 of the detergent container 60. The flow of fluid through the venturi aspirator device 61 creates a low pressure area drawing detergent from the detergent container 60 through tube 70 and mixing the detergent with the water in the conduit 20 and spraying the mixture against the walls 12 of the bathtub 10. Again, after a predetermined time, about 15 seconds, the line 70 from the detergent container 60 is again closed by solenoid switch 63, and only clean water is again passed through the conduit 20, rinsing the detergent mixture from the bathtub 10. Again, after a predetermined time, approximately 30 seconds, solenoid 65 closes access of the water to the conduit 20.

If it is desired to clean the bathtub, but a bath has not been taken, manual "on" switch 82 on the control panel 74 may be pushed, overriding the sensor 84 and starting the entire cycle.

In the preferred embodiment, the entire cycle takes approximately 1½ minutes. Each cycle uses approximately 4 fluid oz. of detergent mixture, so that with a 64 fluid oz. container of detergent, disinfectant and antispotting agent, sixteen cleaning cycles are possible. An electrical sensor, not shown, senses the lack of fluid in the detergent container 60, activating light 80 in panel 74.

Whirlpool switch 88 on the control panel 74 activates the conventional whirlpool operation of the tub. A low water pressure sensor 84 is placed in the low point in the whirlpool water line 90 to prevent the pump 62 from being activated unless there is a minimum level of water in the bathtub 10. Otherwise the whirlpool pump would blow water of the bathtub 10.

The assembly of the bathtub 10 is as follows: The bathtub structure itself is manufactured by conventional means. The hollow tubular conduit 20 is then bent to conform to the outside shape of the bath tub 10 with the flat surface 22 of the conduit 20 pressed against the wall of the tub 10. It is also possible to have the conduit 20 preformed to the shape of the tub 10.

The conduit 20 is then held against the side wall of the tub 10, by any conventional means, such as by hooks depending from the outside wall of the tub 10, by adhesive or epoxy or held in place by hand. The conduit and the tub are then sprayed with fast setting fiberglass so that the conduit 20 is permanently and rigidly affixed to the wall of the tub 10.

A series of holes are then drilled through the inside wall 12 of the tub 10, passing through the wall and into the flat surface 22 of the conduit 20. The expansion nuts 30, having threads on the inside, are then inserted into the openings 28 so that the knurled portion 34 of the expansion nuts 30 is in contact with both the wall of the tub and the opening in the flat surface 22 of the conduit 20. The expansion nut 30 is then expanded by conventional means, such as a power screw driver, forming a leak proof connection from the inside of the conduit 20 to the inside of the bath tub 10. The conduit is attached to the water control system 68 through the wall of the conduit.

Such a manufacturing procedure eliminates concerns with the alignment of openings in the conduit in relationship of the openings in the wall of the tub and at the same time prevents leakage. Fiberglass is water absorbing and will attract the water or fluid if there was any opening between the conduit and tub.

The nozzles 36 are then threaded into the corresponding threaded opening in the expansion nut 30. The nozzles 30 are turned until the slot 40 in the nozzle is positioned in a downward direction.

Figure 8:
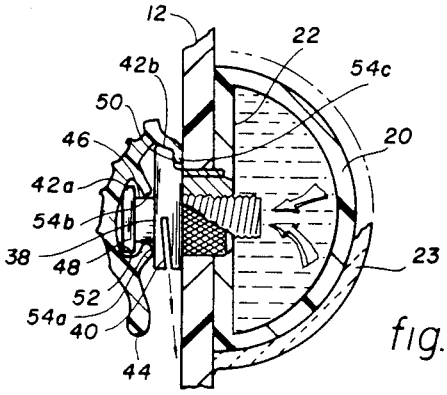
FIG. 8 is a side sectional view taken along line 8—8 of FIG. 7, showing the nozzle cover.
Figure 9:
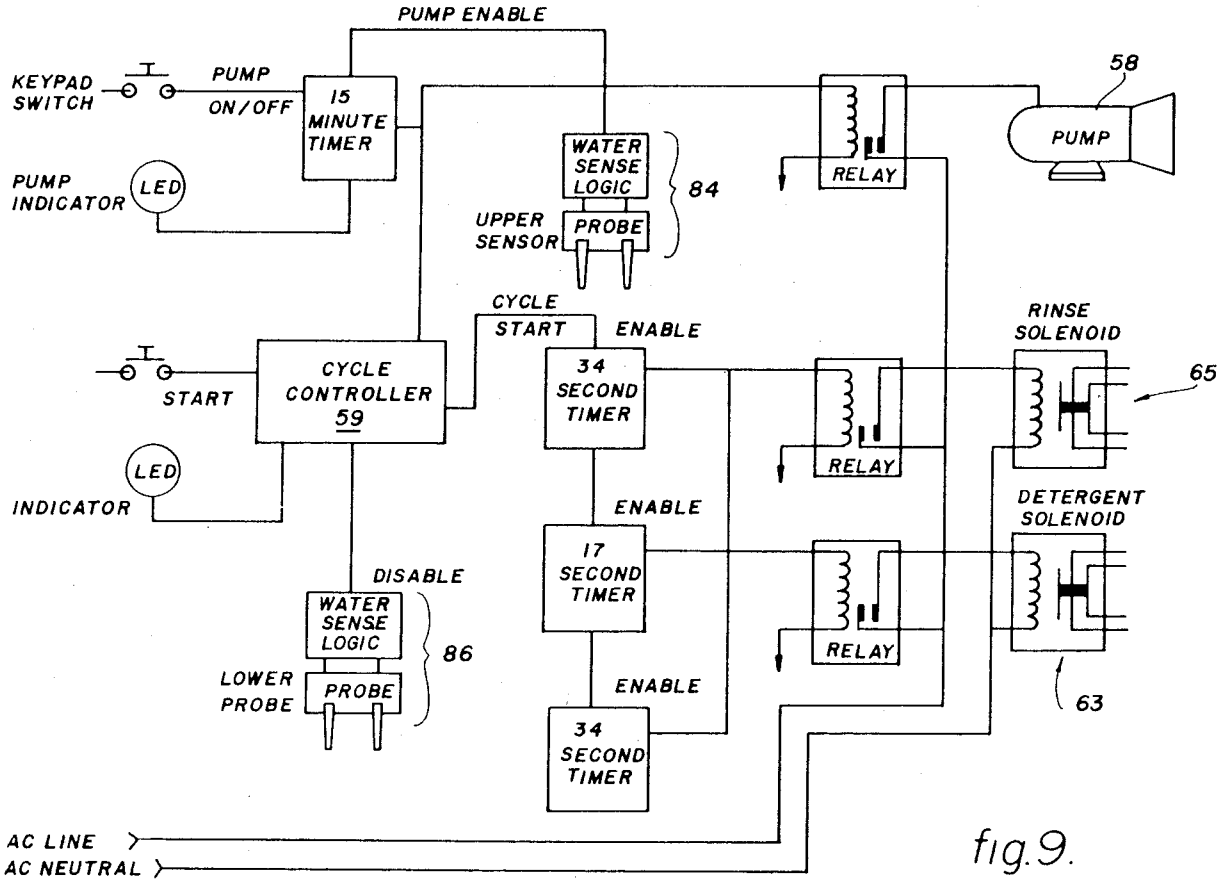
FIG. 9 is a block diagram of the circuitry for controlling the automatic self cleaning operation of the bathtub.
Figure 10:
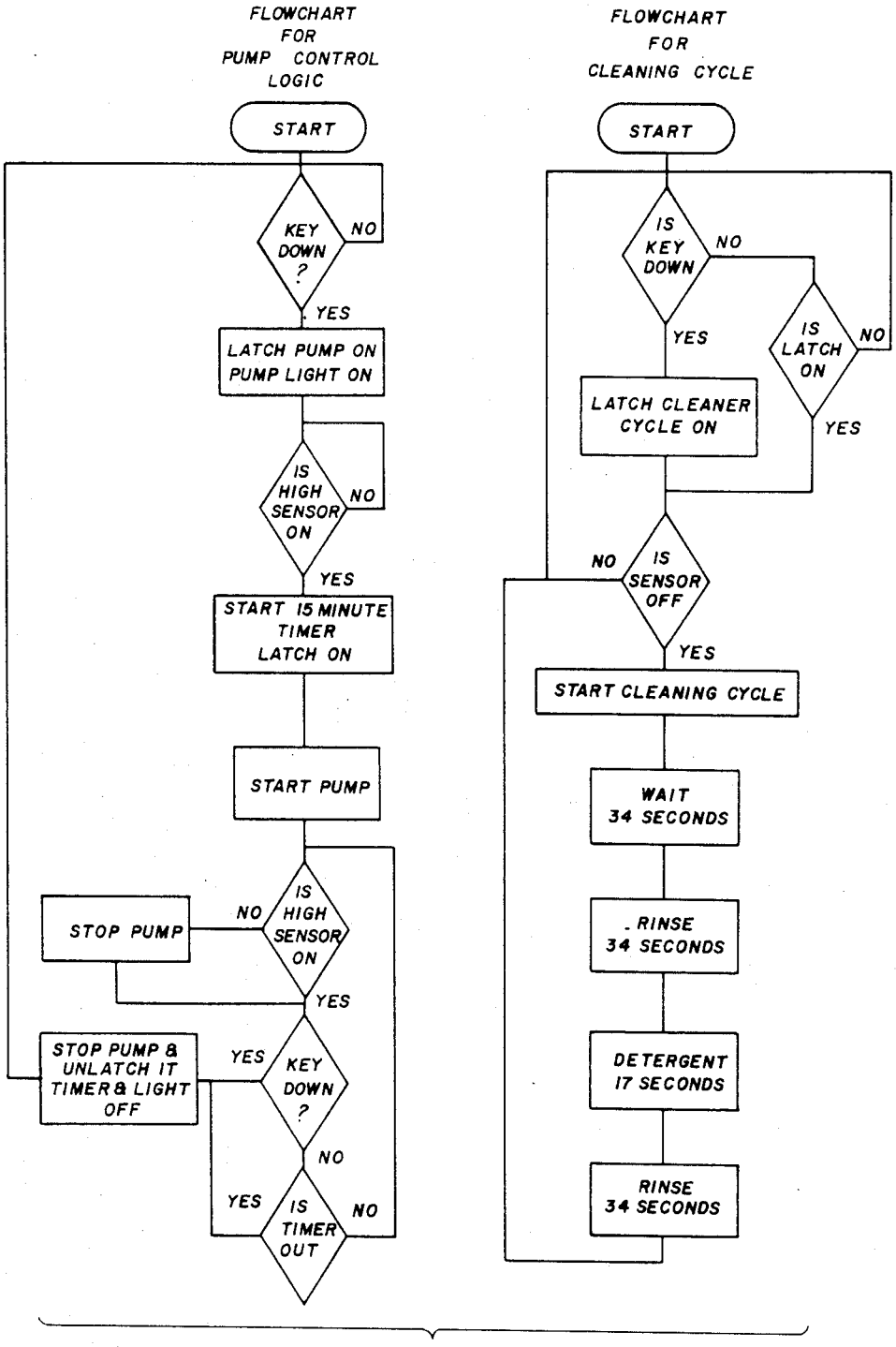
FIG. 10 is a flow chart of the operation of the self cleaning bathtub and pump.

The cover 44 is now ready for being placed over the nozzles 36. In the preferred embodiment, the cover 44 has the projecting ribs 54 slid from the side of each nozzle, such as shown in FIG. 8, so as to engage the narrowed portion 46 and the lip 50 of the nozzle 36, thus holding the cover 44 in place. The cover 44 may be flexible so as to be expanded and stretched over the head 48 of the knob, if so desired.

The described method of manufacture provides a reliable and simple procedure for manufacturing a bath tub which does not leak.

It is recognized that there can be variation of the presently described concept, without departing from the invention disclosed. For example, the tubular conduit 20 could be placed on the inside of the tub 10 and molded directly as a part of the tub itself prior to the curing of the tub. The cover could also be a molded portion of the tub which is hydraulically bent back to permit the nozzles to be inserted in the openings, before returning it to its original position.

What is claimed is:

1. A method for assembling a self cleaning bathtub having a bottom and surrounding walls defining an inside and an outside and a periphery at the top of the surrounding walls comprising the steps of:

(1) applying a hollow tubular member to at least a portion of the outside periphery of said bathtub;

(2) drilling openings through the inside of the bathtub and through a wall of the tubular member;

(3) inserting a water-proof nut having an opening therein in the openings through the inside of the bathtub and wall of the tubular member forming a water-tight passageway; and (4) inserting a nozzle in said passageway for diverting fluid against the inside of the walls of the bathtub.

2. The method of claim 1 in which said tubular member is held in place by fiberglass spray.

3. The method of claim 2 in which said tubular member has a flattened surface.

* * * * *